US007171008B2

(12) United States Patent
Elko

(10) Patent No.: US 7,171,008 B2
(45) Date of Patent: Jan. 30, 2007

(54) REDUCING NOISE IN AUDIO SYSTEMS

(75) Inventor: Gary W. Elko, Summit, NJ (US)

(73) Assignee: MH Acoustics, LLC, Summit, NJ (US)

( * ) Notice: Subject to any disclaimer, the term of this patent is extended or adjusted under 35 U.S.C. 154(b) by 852 days.

(21) Appl. No.: 10/193,825

(22) Filed: Jul. 12, 2002

(65) Prior Publication Data

US 2003/0147538 A1 Aug. 7, 2003

Related U.S. Application Data

(60) Provisional application No. 60/354,650, filed on Feb. 5, 2002.

(51) Int. Cl.
*H04R 3/00* (2006.01)
*H04R 1/02* (2006.01)

(52) U.S. Cl. ..... 381/92; 381/91; 381/122

(58) Field of Classification Search ..... 381/97, 381/91, 92, 122, 95, 317–318, 313, 320–321, 381/94.1–3, 13
See application file for complete search history.

(56) References Cited

U.S. PATENT DOCUMENTS 5,325,872 A 7/1994 Westermann ..... 128/897
5,515,445 A 5/1996 Baumhauer, Jr. et al. ..... 381/92
5,602,962 A 2/1997 Kellermann
5,687,241 A 11/1997 Ludvigsen ..... 381/68.4
5,878,146 A 3/1999 Andersen ..... 381/312
6,272,229 B1 8/2001 Baekgaard ..... 381/313
6,292,571 B1 9/2001 Sjursen ..... 381/312
6,339,647 B1 1/2002 Andersen et al. ..... 381/312

FOREIGN PATENT DOCUMENTS

JP 06303689 10/1994
JP 2001124621 5/2001
WO WO 95 16259 6/1995

*Primary Examiner*—Vivian Chin
*Assistant Examiner*—Douglas Suthers
(74) *Attorney, Agent, or Firm*—Steve Mendelsohn

(57) ABSTRACT

Two or more microphones receive acoustic signals and generate audio signals that are processed to determine what portion of the audio signals result from (i) incoherence between the audio signals and/or (ii) audio-signal sources having propagation speeds different from the acoustic signals. The audio signals are filtered to reduce that portion of one or more of the audio signals. The present invention can be used to reduce turbulent wind-noise resulting from wind or other airjets blowing across the microphones. Time-dependent phase and amplitude differences between the microphones can be compensated for based on measurements made in parallel with routine audio system processing.

55 Claims, 13 Drawing Sheets

REDUCING NOISE IN AUDIO SYSTEMS

CROSS-REFERENCE TO RELATED APPLICATIONS

This application claims the benefit of the filing date of U.S. provisional application No. 60/354,650, filed on Feb. 2, 2002.

BACKGROUND OF THE INVENTION

1. Field of the Invention

The present invention relates to acoustics, and, in particular, to techniques for reducing noise, such as wind noise, generated by turbulent airflow over microphones.

2. Description of the Related Art

For many years, wind-noise sensitivity of microphones has been a major problem for outdoor recordings. A related problem is the susceptibility of microphones to the speech jet, i.e., the flow of air from the talker's mouth. Recording studios typically rely on special windscreen socks that either cover the microphone or are placed between the mouth and the microphone. For outdoor recording situations where wind noise is an issue, microphones are typically shielded by acoustically transparent foam or thick fuzzy materials. The purpose of these windscreens is to reduce—or even eliminate—the airflow over the active microphone element to reduce—or even eliminate—noise associated with that airflow that would otherwise appear in the audio signal generated by the microphone, while allowing the desired acoustic signal to pass without significant modification to the microphone.

SUMMARY OF THE INVENTION

The present invention is related to signal processing techniques that attenuate noise, such as turbulent wind-noise, in audio signals without necessarily relying on the mechanical windscreens of the prior art. In particular, according to certain embodiments of the present invention, two or more microphones generate audio signals that are used to determine the portion of pickup signal that is due to wind-induced noise. These embodiments exploit the notion that wind-noise signals are caused by convective airflow whose speed of propagation is much less than that of the desired acoustic signals. As a result, the difference in the output powers of summed and subtracted signals of closely spaced microphones can be used to estimate the ratio of turbulent convective wind-noise propagation relative to acoustic propagation. Since convective turbulence coherence diminishes quickly with distance, subtracted signals between microphones are of similar power to summed signals. However, signals propagating at acoustic speeds will result in relatively large difference in the summed and subtracted signal powers. This property is utilized to drive a time-varying suppression filter that is tailored to reduce signals that have much lower propagation speeds and/or a rapid loss in signal coherence as a function of distance, e.g., noise resulting from relatively slow airflow.

According to one embodiment, the present invention is a method and an audio system for processing audio signals generated by two or more microphones receiving acoustic signals. A signal processor determines a portion of the audio signals resulting from one or more of (i) incoherence between the audio signals and (ii) one or more audio-signal sources having propagation speeds different from the acoustic signals. A filter filters at least one of the audio signals to reduce the determined portion.

According to another embodiment, the present invention is a consumer device comprising (a) two or more microphones configured to receive acoustic signals and to generate audio signals; (b) a signal processor configured to determine a portion of the audio signals resulting from one or more of (i) incoherence between the audio signals and (ii) one or more audio-signal sources having propagation speeds different from the acoustic signals; and (c) a filter configured to filter at least one of the audio signals to reduce the determined portion.

According to yet another embodiment, the present invention is a method and an audio system for processing audio signals generated in response to a sound field by at least two microphones of an audio system. A filter filters the audio signals to compensate for a phase difference between the at least two microphones. A signal processor (1) generates a revised phase difference between the at least two microphones based on the audio signals and (2) updates, based on the revised phase difference, at least one calibration parameter used by the filter.

In yet another embodiment, the present invention is a consumer device comprising (a) at least two microphones; (b) a filter configured to filter audio signals generated in response to a sound field by the at least two microphones to compensate for a phase difference between the at least two microphones; and (c) a signal processor configured to (1) generate a revised phase difference between the at least two microphones based on the audio signals; and (2) update, based on the revised phase difference, at least one calibration parameter used by the filter.

BRIEF DESCRIPTION OF THE DRAWINGS

Other aspects, features, and advantages of the present invention will become more fully apparent from the following detailed description, the appended claims, and the accompanying drawings in which like reference numerals identify similar or identical elements.

DETAILED DESCRIPTION

Differential Microphone Arrays

A differential microphone array is a configuration of two or more audio transducers or sensors (e.g., microphones) whose audio output signals are combined to provide one or more array output signals. As used in this specification, the term "first-order" applies to any microphone array whose sensitivity is proportional to the first spatial derivative of the acoustic pressure field. The term "$n^{th}$-order" is used for microphone arrays that have a response that is proportional to a linear combination of the spatial derivatives up to and including n. Typically, differential microphone arrays combine the outputs of closely spaced transducers in an alternating sign fashion.

Although realizable differential arrays only approximate the true acoustic pressure differentials, the equations for the general-order spatial differentials provide significant insight into the operation of these systems. To begin, the case for an acoustic planewave propagating with wave vector k is examined. The acoustic pressure field for the planewave case can be written according to Equation (1) as follows:

$$p(k, r, t) = P_o e^{j(\omega t - kr)} \tag{1}$$

where $P_o$ is the planewave amplitude, k is the acoustic wave vector, r is the position vector relative to the selected origin, and ω is the angular frequency of the planewave. Dropping the time dependence and taking the $n^{th}$-order spatial derivative yields Equation (2) as follows:

$$\frac{d^n}{dr^n} p(k, r) = P_o(-jk\cos\theta)^n e^{jk\cdot r}$$

where θ is the angle between the wavevector k and the position vector r, $r=\|r\|$, and $k=\|k\|=2\pi/\lambda$, where λ is the acoustic wavelength. The planewave solution is valid for the response to sources that are "far" from the microphone array, where "far" means distances that are many times the square of the relevant source dimension divided by the acoustic wavelength. The frequency response of a differential microphone is a high-pass system with a slope of 6n dB per octave. In general, to realize an array that is sensitive to the $n^{th}$ derivative of the incident acoustic pressure field, m $p^{th}$-order transducers are required, where, $m+p-1=n$. For example, a first-order differential microphone requires two zero-order sensors (e.g., two pressure-sensing microphones).

Figure 1:
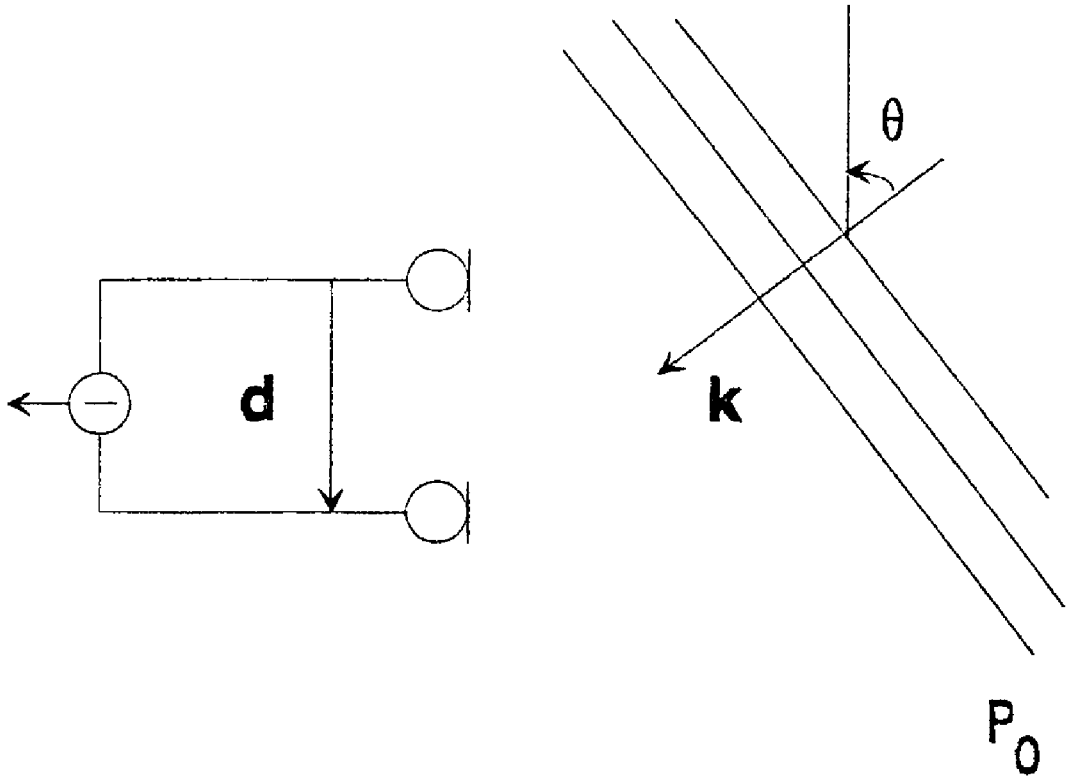
FIG. 1 shows a diagram of a first-order microphone composed of two zero-order microphones.

For a planewave with amplitude $P_0$ and wavenumber k incident on a two-element differential array, as shown in FIG. 1, the output can be written according to Equation (3) as follows:

$$T_1(k,\theta)=P_o(1-e^{-jkd\cos\theta}) \tag{3}$$

where d is the inter-element spacing and the subscript indicates a first-order differential array. If it is now assumed that the spacing d is much smaller than the acoustic wavelength, Equation (3) can be rewritten as Equation (4) as follows:

$$|T_1(k,\theta)|\approx P_o kd\cos\theta \tag{4}$$

The case where a delay is introduced between these two zero-order sensors is now examined. For a planewave incident on this new array, the output can be written according to Equation (5) as follows:

$$T_1(\omega,\theta)=P_o(1-e^{-j\omega(\tau+d\cos\theta/c)}) \tag{5}$$

where τ is equal to the delay applied to the signal from one sensor, and the substitution $k=\omega/c$ has been made, where c is the speed of sound. If a small spacing is again assumed ($kd \ll \pi$ and $\omega\tau \ll \pi$), then Equation (5) can be written as Equation (6) as follows:

$$|T_1(\omega,\theta)|\approx P_o\omega(\tau+d/c\cos\theta) \tag{6}$$

One thing to notice about Equation (6) is that the first-order array has first-order high-pass frequency dependence. The term in the parentheses in Equation (6) contains the array directional response.

Since $n^{th}$-order differential transducers have responses that are proportional to the $n^{th}$ power of the wavenumber, these transducers are very sensitive to high wavenumber acoustic propagation. One acoustic field that has high-wavenumber acoustic propagation is in turbulent fluid flow where the convective velocity is much less than the speed of sound. As a result, prior-art differential microphones have typically required careful shielding to minimize the hypersensitivity to wind turbulence.

Turbulent Wind-Noise Models

The subject of modeling turbulent fluid flow has been an active area of research for many decades. Most of the research has been in underwater acoustics for military applications. With the rapid growth of commercial airline carriers, there has been a great amount of work related to turbulent flow excitation of aircraft fuselage components. Due to the complexity of the equations of motion describing turbulent fluid flow, only rough approximations and relatively simple statistical models have been suggested to describe this complex chaotic fluid flow. One model that describes the coherence of the pressure fluctuations in a turbulent boundary layer along the plane of flow is described in G. M. Corcos, *The structure of the turbulent pressure field in boundary layer flows*, J. Fluid Mech., 18: pp. 353–378, 1964, the teachings of which are incorporated herein by reference. Although this model was developed for turbulent pressure fluctuation over a rigid half-plane, the simple Corcos model can be used to express the amount of spatial filtering of the turbulent jet from a talker. Thus, this model is used to predict the spatial coherence of the pressure-fluctuation turbulence for both speech jets as well as free-space turbulence.

The spatial characteristics of the pressure fluctuations can be expressed by the space-frequency cross-spectrum function G according to Equation (7) as follows:

$$G_{P_1P_2}(\psi, \omega) = \int_{-\infty}^{\infty} R_{P_1P_2}(\psi, \tau)e^{-j\omega\tau}\, d\tau \tag{7}$$

where R is the spatial cross-correlation function between the two microphone signals, ω is the angular frequency, and ψ is the general displacement variable which is directly related to the distance between measurement points. The coherence function γ is defined as the normalized cross-spectrum by the auto power-spectrum of the two channels according to Equation (8) as follows:

$$\gamma(r, \omega) = \frac{|G_{P_1P_2}|}{[G_{P_1P_2}(\omega)G_{P_2P_2}(\omega)]^{1/2}} \tag{8}$$

Figure 2:
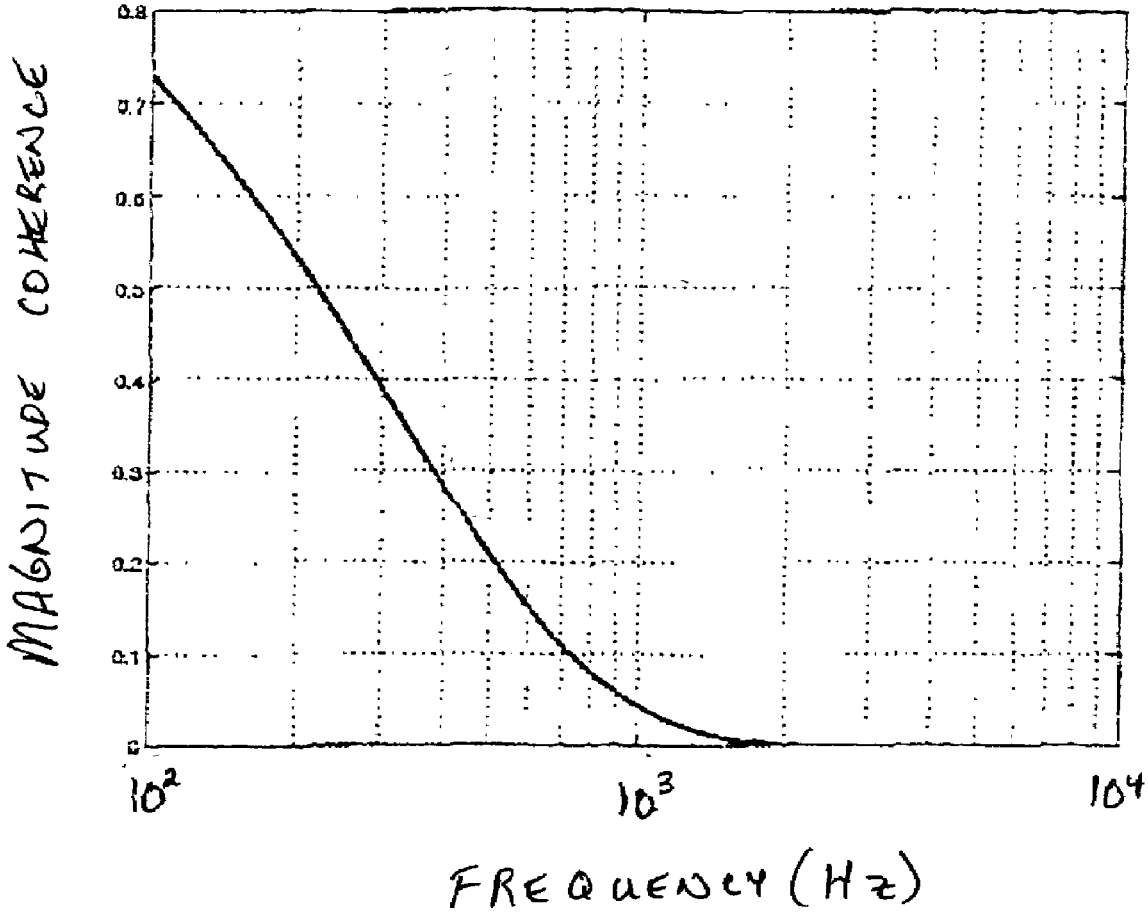
FIG. 2 shows a graph of Corcos model coherence as a function of frequency for 2-cm microphone spacing and a convective speed of 5 m/s.
Figure 3:
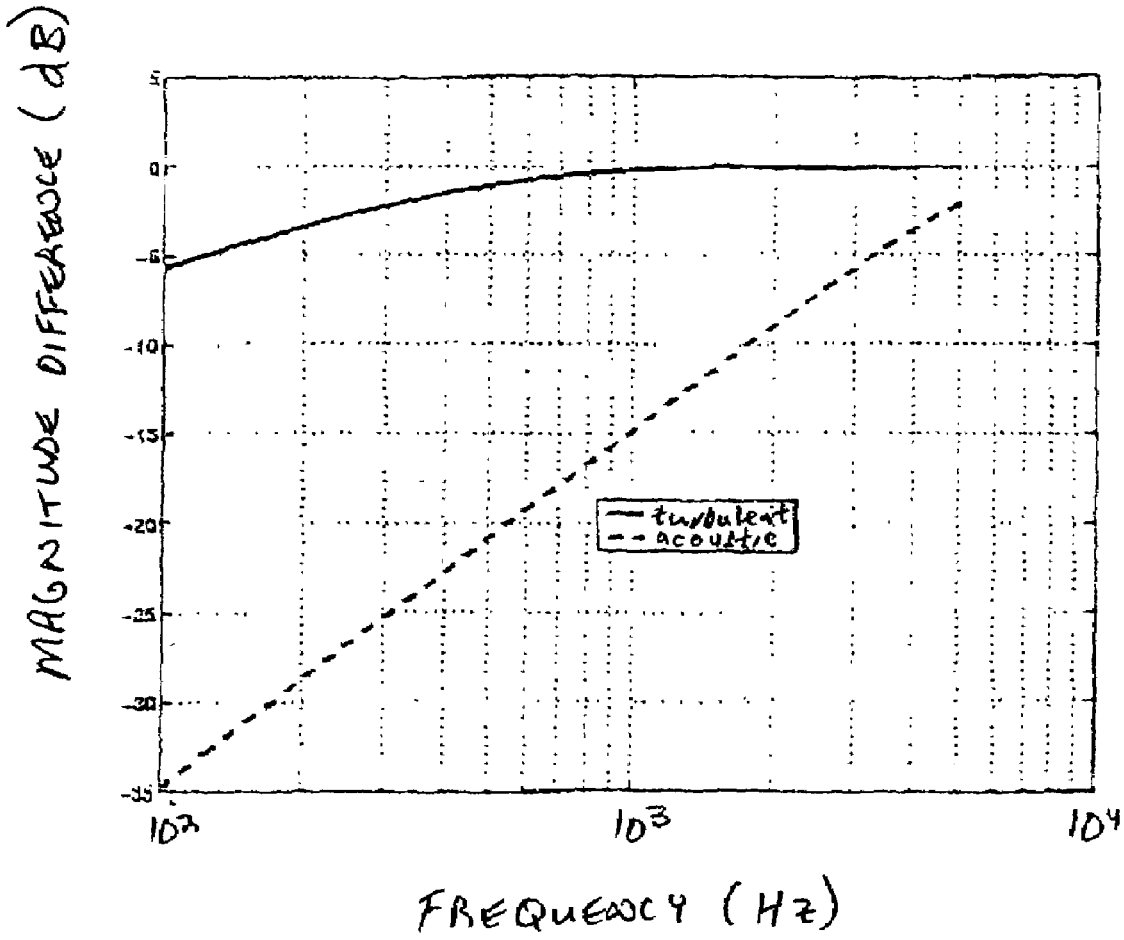
FIG. 3 shows a graph of the difference-to-sum power ratios for acoustic and turbulent signals as a function of frequency for 2-cm microphone spacing and a convective speed of 5 m/s.

It is known that large-scale components of the acoustic pressure field lose coherence slowly during the convection with free-stream velocity U, while the small-scale components lose coherence in distances proportional to their wavelengths. Corcos assumed that the stream-wise coherence decays spatially as a function of the similarity variable $\omega r/U_c$, where $U_c$ is the convective speed and is typically related to the free-stream velocity U as $U_c$=0.8U. The Corcos model can be mathematically stated by Equation (9) as follows:

$$\gamma(r, \omega) = \exp\left(\frac{-\alpha\omega r}{U_c}\right) \tag{9}$$

where α is an experimentally determined decay constant (e.g., α=0.125), and r is the displacement (distance) variable. A plot of this function is shown in FIG. 2. The rapid decay of spatial coherence results in the difference in powers between the sums and differences of closely-spaced pressure (zero-order) microphones to be much smaller than for an acoustic planewave propagating along the microphone array axis. As a result, it is possible to detect whether the acoustic signals transduced by the microphones are turbulent-like or propagating acoustic signals by comparing the sum and difference signal powers. FIG. 3 shows the difference-to-sum power ratios (i.e., the ratio of the difference signal power to the sum signal power) for acoustic and turbulent signals for a pair of omnidirectional microphones spaced at 2 cm in a convective fluid flow propagating at 5 m/s. It is clearly seen in this figure that there is a relatively wide difference between the desired acoustic and turbulent difference-to-sum power ratios. The ratio difference becomes more pronounced at low frequencies since the differential microphone output for desired acoustic signals rolls off at −6 dB/octave, while the predicted, undesired turbulent component rolls off at a much slower rate.

If sound arrives from off-axis from the microphone array, the difference-to-sum power ratio becomes even smaller. (It has been assumed that the coherence decay is similar in directions that are normal to the flow). The closest the sum and difference powers come to each other is for acoustic signals propagating along the microphone axis (e.g., when θ=0 in FIG. 1). Therefore, the power ratio for acoustic signals will be less than or equal to the power ratio for acoustic signals arriving along the microphone axis. This limiting approximation is important to the present invention's detection and resulting suppression of signals that are identified as turbulent.

Single-Channel Wiener Filter

It was shown in the previous section that one way to detect turbulent energy flow over a pair of closely-spaced microphones is to compare the scalar sum and difference signal power levels. In this section, it is shown how to use the measured power ratio to suppress the undesired wind-noise energy.

One common technique used in noise reduction for single input systems is the well-known technique of spectral subtraction. See, e.g., S. F. Boll, *Suppression of acoustic noise in speech using spectral subtraction*, IEEE Trans. Acoust. Signal Proc., vol. ASSP-27, Apr. 1979, the teachings of which are incorporated herein by reference. The basic premise of the spectral subtraction algorithm is to parametrically estimate the optimal Wiener filter for the desired speech signal. The problem can be formulated by defining a noise-corrupted speech signal y(n) according to Equation (10) as follows:

$$y(n)=s(n)+v(n) \tag{10}$$

where s(n) is the desired signal and vn) is the noise signal.

Figure 4:
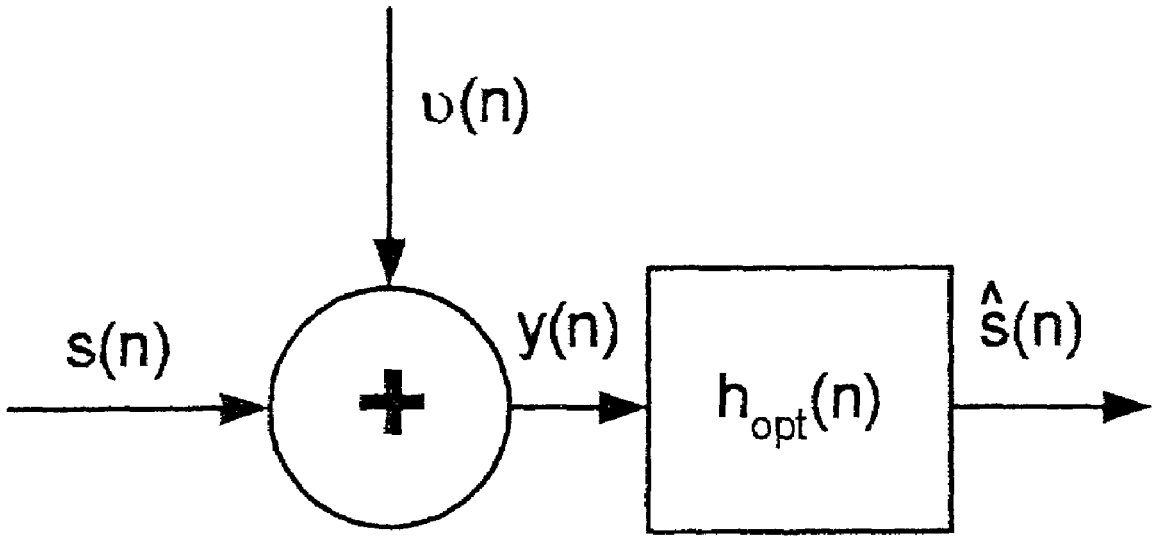
FIG. 4 illustrates noise suppression using a single-channel Wiener filter.

FIG. 4 illustrates noise suppression using a single-channel Wiener filter. The optimal filter is a filter that, when convolved with the noisy signal y(n), yields the closest (in the mean-square sense) approximation to the desired signal s(n). This can be represented in equation form according to Equation (11) as follows:

$$\hat{s}(n)=h_{opt}*y(n) \tag{11}$$

where "*" denotes convolution. The optimal filter that minimizes the mean-square difference between s(n) and ŝ(n) is the Wiener filter. In the frequency domain, the result is given by Equation (12) as follows:

$$H_{opt}(\omega) = \frac{G_{ys}(\omega)}{G_{yy}(\omega)} \tag{12}$$

where $G_{ys}(\omega)$ is the cross-spectrum between the signals s(n) and y(n), and $G_{yy}(\omega)$ is the auto power-spectrum of the signal y(n). Since the noise and desired signals are assumed to be uncorrelated, the result can be rewritten according to Equation (13) as follows:

$$H_{opt}(\omega) = \frac{G_{ss}(\omega)}{G_{ss}(\omega) + G_{vv}(\omega)} \tag{13}$$

Rewriting Equation (11) into the frequency domain and substituting terms yields Equation (14) as follows:

$$\hat{S}(\omega) = \left[\frac{G_{yy}(\omega) - G_{vv}(\omega)}{G_{yy}(\omega)}\right]Y(\omega) \tag{14}$$

This result is the basic equation that is used in most spectral subtraction schemes. The variations in spectral subtraction/spectral suppression algorithms are mostly based on how the estimates of the auto power-spectrums of the signal and noise are made.

When speech is the desired signal, the standard approach is to use the transient nature of speech and assume a stationary (or quasi-stationary) noise background. Typical implementations use short-time Fourier analysis-and-synthesis techniques to implement the Wiener filter. See, e.g., E. J. Diethorn, "Subband Noise Reduction Methods," Acoustic Signal Processing for Telecommunication, S. L. Gay and J. Benesty, eds., Kluwer Academic Publishers, Chapter 9, pp. 155–178. Mar. 2000, the teachings of which are incorporated herein by reference. Since both speech and turbulent noise excitation are non-stationary processes, one would have to implement suppression schemes that are capable of tracking time-varying signals. As such, time-varying filters should be implemented. In the frequency domain, this can be accomplished by using short-time Fourier analysis and synthesis or filter-bank structures.

Multi-Channel Wiener Filter

Figure 5:
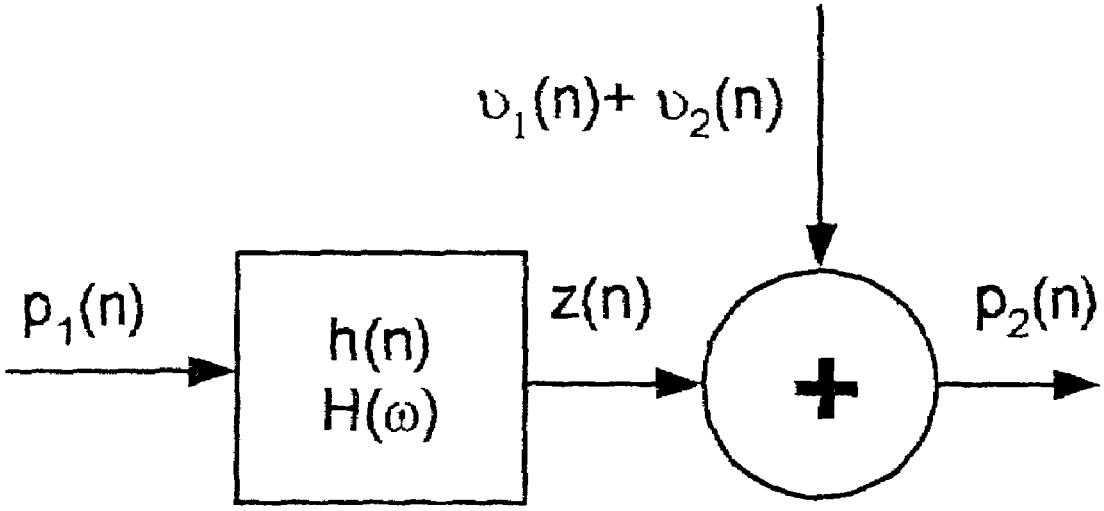
FIG. 5 illustrates a single-input/single-output noise suppression system that is essentially equivalent to a system having an array with two closely spaced omnidirectional microphones.

The previous section discussed the implementation of the single-channel Wiener filter. However, the use of microphone arrays allows for the possibility of having multiple channels. A relatively simple case is a first-order differential microphone that utilizes two closely-space omnidirectional microphones. This arrangement can be seen to be essentially equivalent to a single-input/single-output system as shown in FIG. 5, where the desired "noise-free" signal is shown as z(n). It is assumed that the noise signals at both microphones are uncorrelated, and thus the two noises can be added equivalently as a single noise source. If the added noise signal is defined as $v(n)=v_1(n)+v_2(n)$, then the output from the second microphone can be written according to Equation (15) as follows:

$$G_{p2p2}(\omega)=G_{vv}(\omega)+|H(\omega)|^2 G_{p1p1}(\omega) \tag{15}$$

From the previous definition of the coherence function, it can be shown that the output noise spectrum is given by Equation (16) as follows:

$$G_{vv}(\omega) = [1-\gamma^2_{p1p2}(\omega)]G_{p2p2}(\omega) \tag{16}$$

and the coherent output power is given by Equation (17) as follows:

$$G_{zz}(\omega) = \gamma^2_{p1p2}(\omega)G_{p2p2}(\omega) \tag{17}$$

Thus the signal-to-noise ratio is given by Equation (18) as follows:

$$SNR(\omega) = \frac{G_{zz}(\omega)}{G_{vv}(\omega)} = \frac{\gamma^2_{p1p2}(\omega)}{1-\gamma^2_{p1p2}(\omega)} \tag{18}$$

Using the expression for the Wiener filter given by Equation (13) suggests a simple Wiener-type spectral suppression algorithm according to Equation (19) as follows:

$$H_{opt}(\omega) = \gamma^2_{p1p2}(\omega) \tag{19}$$

Figure 6:
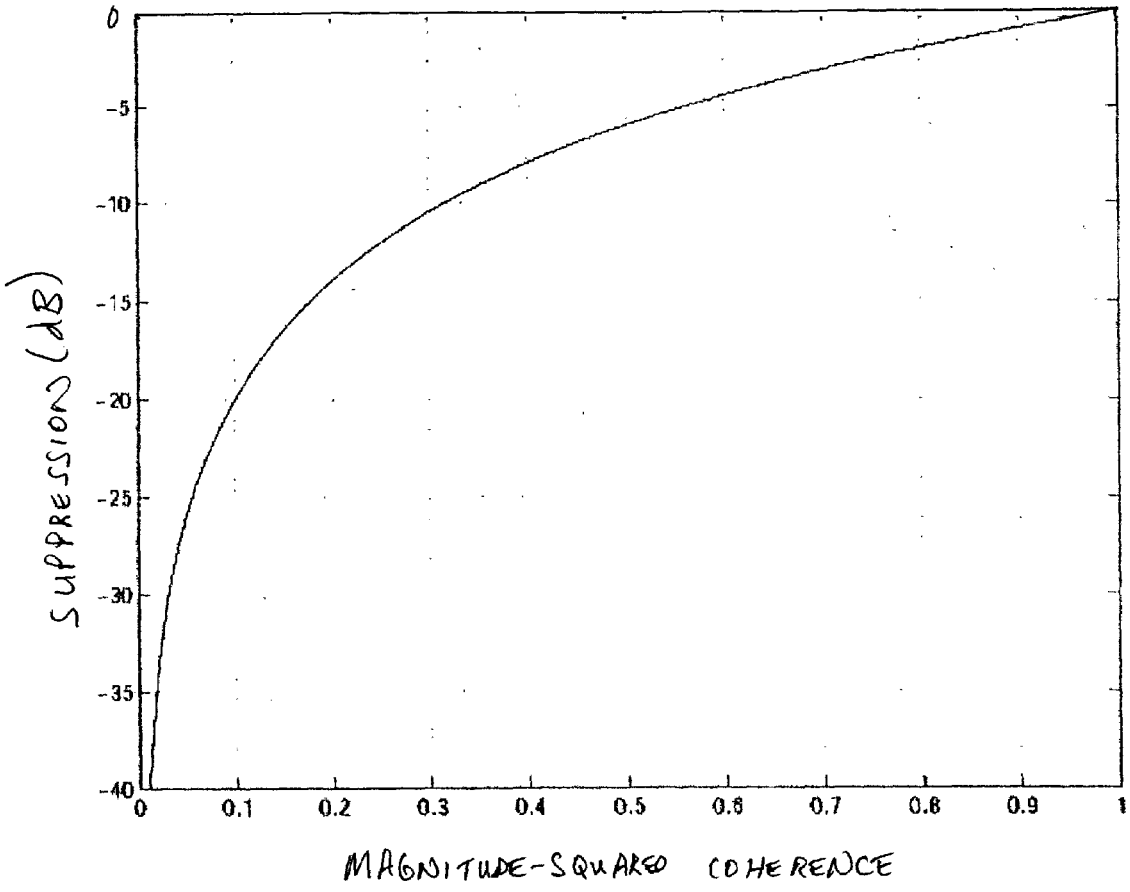
FIG. 6 shows the amount of noise suppression that is applied by the system of FIG. 5 as a function of coherence between the two microphone signals.

FIG. 6 shows the amount of noise suppression that is applied as a function of coherence between the two microphone signals.

One major issue with implementing a Wiener noise reduction scheme as outlined above is that typical acoustic signals are not stationary random processes. As a result, the estimation of the coherence function should be done over short time windows so as to allow tracking of dynamic changes. This problem turns out to be substantial when dealing with turbulent wind-noise that is inherently highly non-stationary. Fortunately, there are other ways to detect incoherent signals between multi-channel microphone systems with highly non-stationary noise signals. One way that is effective for wind-noise turbulence, slowly propagating signals, and microphone self-noise, is described in the next section.

It is straightforward to extend the two-channel results presented above to any number of channels by the use of partial coherence functions that provide a measure of the linear dependence between a collection of inputs and outputs. A multi-channel least-squares estimator can also be employed for the signals that are linearly related between the channels.

Wind-Noise Suppression

The goal of turbulent wind-noise suppression is to determine what frequency components are due to turbulence (noise) and what components are desired acoustic signal. Combining the results of the previous sections indicates how to proceed. The noise power estimation algorithm is based on the difference in the powers of the sum and difference signals. If these differences are much smaller than the maximum predicted for acoustic signals (i.e., signals propagating along the axis of the microphones), then the signal may be declared turbulent and used to update the noise estimation. The gain that is applied can be the Wiener gain as given by Equations (14) and (19), or a weighting (preferably less than 1) that can be uniform across frequency. In general, the gain can be any desired function of frequency.

One possible general weighting function would be to enforce the difference-to-sum power ratio that would exist for acoustic signals that are propagating along the axis of the microphones. The fluctuating acoustic pressure signals traveling along the microphone axis can be written for both microphones as follows:

$$p_1(t)=s(t)+v_1(t)+n_1(t)$$

$$p_2(t)=s(t-\tau_s)+v_1(t-\tau_v)+n_2(t) \tag{20}$$

where $\tau_s$ is the delay for the propagating acoustic signal s(t), $\tau_v$ is the delay for the convective or slow propagating waves, and $n_1(t)$ and $n_2(t)$ represent microphone self-noise and/or incoherent turbulent noise at the microphones. If the signals are represented in the frequency domain, the power spectrum of the pressure sum $(p_1(t)+p_2(t))$ and difference signals $(p_1(t)-p_2(t))$ can be written as follows:

$$G_d(\omega) = 4P_o^2(\omega)\sin^2\left(\frac{\omega d}{2c}\right) + 4\Upsilon^2(\omega)\gamma_c^2(\omega)\sin^2\left(\frac{\omega d}{2U_c}\right) + 2\Upsilon^2(\omega)[1-\gamma_c^2(\omega)] + N_1^2(\omega) + N_2^2(\omega) \tag{21}$$

and $$G_s(\omega) = 4P_o^2(\omega) + 4\Upsilon^2(\omega)\gamma_c^2(\omega) + 2\Upsilon^2(\omega)[1-\gamma_c^2(\omega)] + N_1^2(\omega) + N_2^2(\omega) \tag{22}$$

The ratio of these factors (denoted as PR ) gives the expected power ratio of the difference and sum signals between the microphones as follows:

$$PR(\omega) = \frac{G_d(\omega)}{G_s(\omega)} \tag{23}$$

where $\gamma_c$ is the turbulence coherence as measured or predicted by the Corcos or other turbulence model, $Y(\omega)$ is the RMS power of the turbulent noise, and $N_1$ and $N_2$ represent the RMS power of the independent noise at the microphones due to sensor self-noise. For turbulent flow where the convective wave speed is much less than the speed of sound, the power ratio will be much greater (by approximately the ratio of propagation speeds) and thereby moves the power ratio to unity. Also, as discussed earlier, the convective turbulence spatial correlation function decays rapidly, and this term becomes dominant when turbulence (or independent sensor self-noise is present) and thereby moves the power ratio towards unity. For a purely propagating acoustic signal traveling along the microphone axis, the power ratio is as follows:

$$PR_a(\omega) = \sin^2\left(\frac{\omega d}{2c}\right) \tag{24}$$

For general orientation of a single plane-wave where the angle between the planewave and the microphone axis is $\theta$, $$PR_a(\omega, \theta) = \sin^2\left(\frac{\omega d \cos\theta}{2c}\right) \tag{25}$$

The results shown in Equations (24)–(25) lead to an algorithm for suppression of airflow turbulence and sensor self-noise. The rapid decay of spatial coherence or large difference in propagation speeds, results in the relative powers between the sums and differences of the closely spaced pressure (zero-order) microphones to be much smaller than for an acoustic planewave propagating along the microphone array axis. As a result, it is possible to detect whether the acoustic signals transduced by the microphones are turbulent-like noise or propagating acoustic signals by comparing the sum and difference powers.

FIG. 3 shows the difference-to-sum power ratio for a pair of omnidirectional microphones spaced at 2 cm in a convective fluid flow propagating at 5 m/s. It is clearly seen in this figure that there is a relatively wide difference between the acoustic and turbulent sum-difference power ratios. The ratio differences become more pronounced at low frequencies since the differential microphone rolls off at −6 dB/octave, where the predicted turbulent component rolls off at a much slower rate.

If sound arrives from off-axis from the microphone array, the ratio of the difference-to-sum power levels becomes even smaller as shown in Equation (25). Note that it has been assumed that the coherence decay is similar in directions that are normal to the flow. The closest the sum and difference powers come to each other is for acoustic signals propagating along the microphone axis. Therefore, if acoustic waves are assumed to be propagating along the microphone axis, the power ratio for acoustic signals will be less than or equal to acoustic signals arriving along the microphone axis. This limiting approximation is the key to preferred embodiments of the present invention relating to noise detection and the resulting suppression of signals that are identified as turbulent and/or noise. The proposed suppression gain $SG(\omega)$ can thus be stated as follows: If the measured ratio exceeds that given by Equation (25), then the output signal power is reduced by the difference between the measured power ratio and that predicted by Equation (25). The equation that implements this gain is as follows:

$$SG(\omega) = \frac{PR_a(\omega)}{PR_m(\omega)} \tag{26}$$

where $PR_m(\omega)$ is the measured sum and difference signal power ratio.

Figure 7:
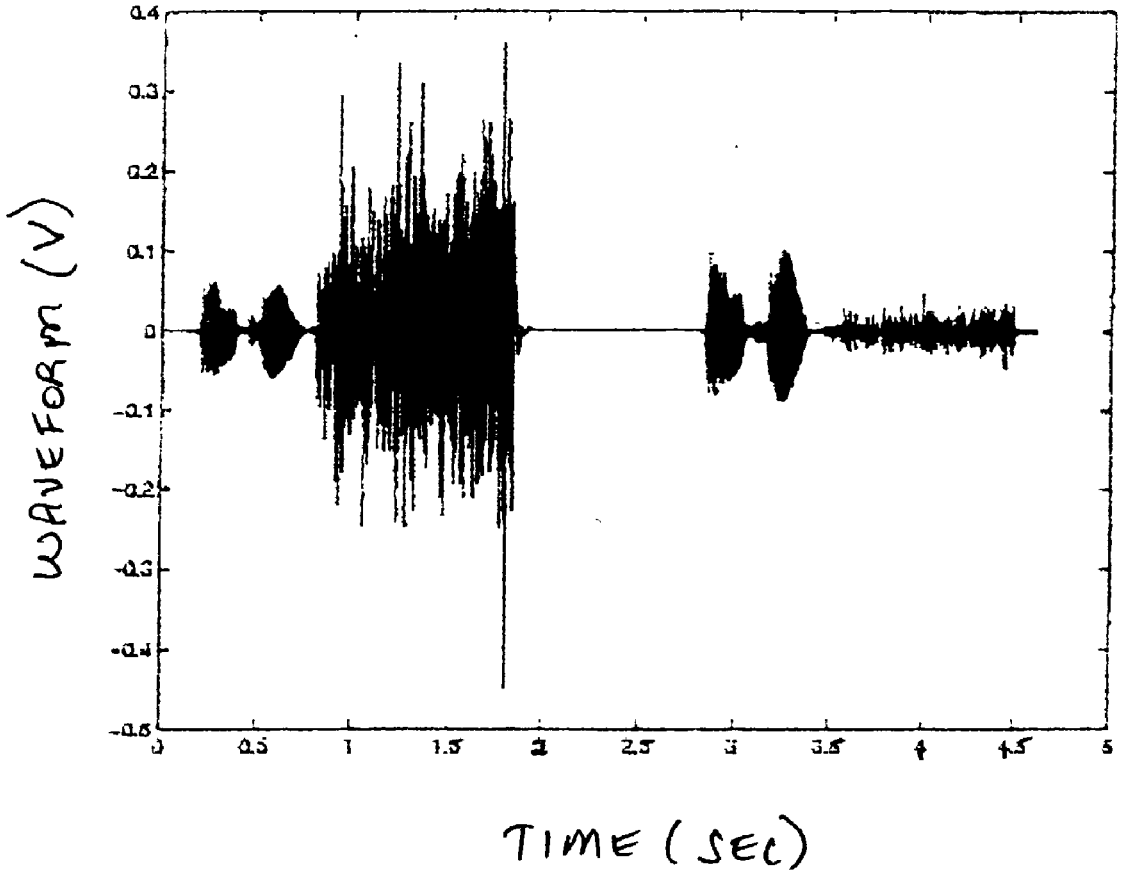
FIG. 7 shows a graph of the output signal for a single microphone before and after processing to reject turbulence using propagating acoustic gain settings.

FIG. 7 shows the signal output of one of the microphone pair signals before and after applying turbulent noise suppression using the weighting gain as given in Equation (25). The turbulent noise signal was generated by softly blowing across the microphone after saying the phrase "one, two." The reduction in turbulent noise is greater than 20 dB. The actual suppression was limited to 25 dB since it was conjectured that this would be reasonable and that suppression artifacts might be audible if the suppression were too large. It is easy to see the acoustic signals corresponding to the words "one" and "two." This allows one to compare the before and after processing visually in the figure. One reason that the proposed suppression technique is so effective for flow turbulence is due to the fact that these signals have large low frequencies power, a region where $PR_a$ is small.

Figure 8:
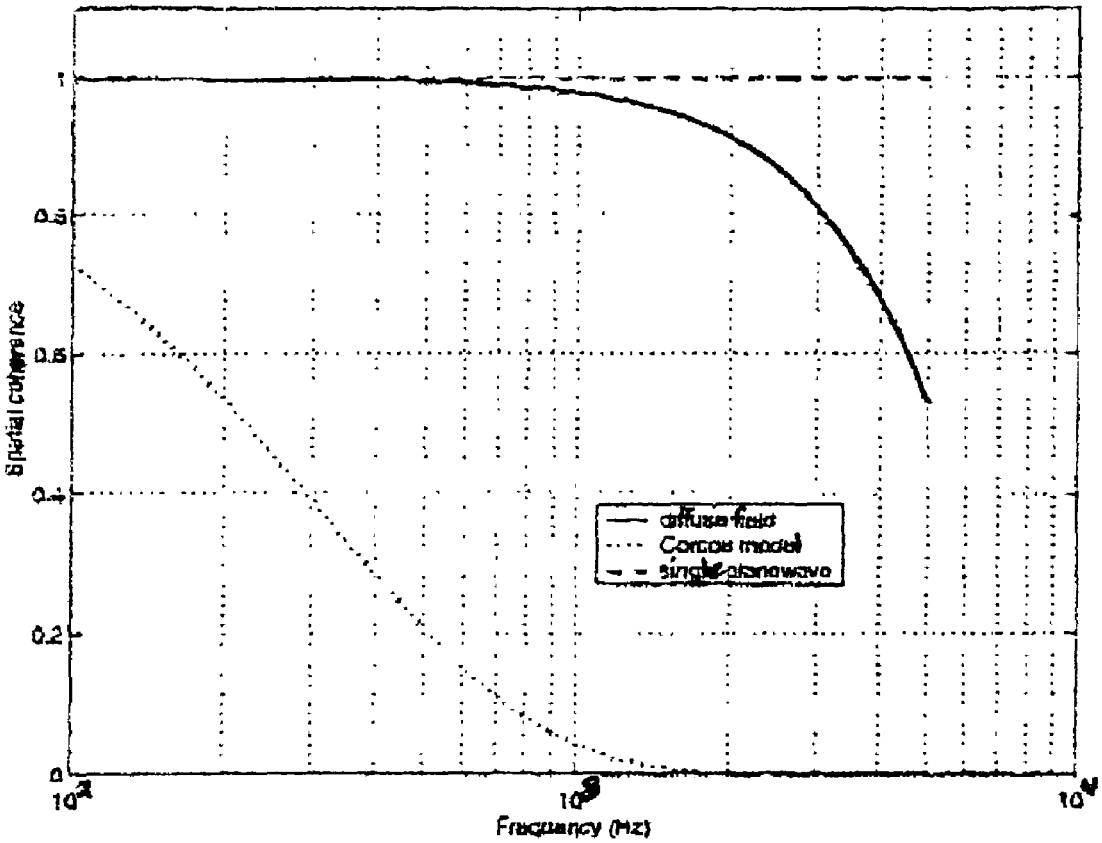
FIG. 8 shows a graph of the spatial coherence function for a diffuse propagating acoustic field for 2-cm spaced microphones, shown compared with the Corcos model coherence of FIG. 2 and for a single planewave.

Another implementation that is directly related to the Wiener filter solution is to utilize the estimated coherence function between pairs of microphones to generate a coherence-based gain function to attenuate turbulent components. As indicated by FIG. 2, the coherence between microphones decays rapidly for turbulent boundary layer flow as frequency increases. For a diffuse sound field (e.g., uncorrelated sound arriving with equal power from all directions), the spatial coherence function is real and can be shown to be equal to Equation (27) as follows:

$$\gamma(r, \omega) = \frac{|\sin(\omega r / c)|}{\omega r / c} \tag{27}$$

where r=d is the microphone spacing. The coherence function for a single propagating planewave is unity over the entire frequency range. As more uncorrelated planewaves arriving from different directions are incorporated, the spatial coherence function converges to the value for the diffuse case as given in Equation (16). A plot of the diffuse coherence function of Equation (27) is shown in FIG. 8. For comparison purposes, the predicted Corcos coherence functions for 5 m/s flow and for a single planewave are also shown.

As indicated by FIG. 8, there is a relatively large difference in the coherence values for a propagating sound field and a turbulent fluid flow (5 m/s for this case). The large difference suggests that one could weight the resulting spectrum of the microphone output by either the coherence function itself or some weighted or processed version of the coherence. Since the coherence for propagating acoustic waves is essentially unity, this weighting scheme will pass the desired propagating acoustic signals. For turbulent propagation, the coherence (or some processed version) is low and weighting by this function will diminish the system output.

Wind-Noise Sensitivity in Differential Microphones

As described in the section entitled "Differential Microphone Arrays," the sensitivity of differential microphones is proportional to $k^n$, where $|k|=k=\omega/c$ and n is the order of the array. For convective turbulence, the speed of the convected fluid perturbations is much less that the propagation speed for radiating acoustic signals. For wind noise, the difference between propagating speeds is typically about two orders of magnitude. As a result, for convective turbulence and propagating acoustic signals at the same frequency, the wavenumber ratio will differ by about two orders of magnitude. Since the sensitivity of differential microphones is proportional to $k_n$, the output signal power ratio for turbulent signals will typically be about two orders of magnitude greater than the power ratio for propagating acoustic signals for equivalent levels of pressure fluctuation. As described in the section entitled "Turbulent Wind-Noise Models," the coherence of the turbulence decays rapidly with distance. Thus, the difference-to-sum power ratio is even larger than the ratio of the convective-to-acoustic propagating speeds.

Microphone Calibration

The techniques described above work best when the microphone elements (i.e., the different transducers) are fairly closely matched in both amplitude and phase. This matching of microphone elements is also important in applications that utilize multiple closely spaced microphones for directional beamforming. Clearly, one could calibrate the sensors during manufacturing and eliminate this issue. However, there is the possibility that the microphones may deviate in sensitivity and phase over time. Thus, a technique that automatically calibrates the microphone channels is desirable. In this section, a relatively straightforward algorithm is proposed. Some of the measures involved in implementing this algorithm are similar to those involved in the detection of turbulence or propagating acoustic signals.

The calibration of amplitude differences may be accomplished by exploiting the knowledge that the microphones are closely spaced and, as such, will have very similar acoustic pressures at their diaphragms. This is especially true at low frequencies. See, e.g., U.S. Pat. No. 5,515,445, the teachings of which are incorporated herein by reference. Phase calibration is more difficult. One technique that would enable phase calibration can be understood by examining the spatial coherence values for the sum (omnidirectional) and difference (dipole) signals between closely spaced microphones. The spatial coherence can be expressed as the integral (in 2-D or 3-D) of the directional properties of a microphone pair. See, e.g., G. W. Elko, "Spatial Coherence Functions for Differential Microphones in Isotropic Noise Fields," Microphone Arrays:: Signal Processing Techniques and Applications, Springer-Verlag, M. Brandstein and D. Ward, Eds., Chapter 4, pp. 61–85, 2001, the teachings of which are incorporated herein by reference.

If it is assumed that the acoustic field is spatially homogeneous (i.e., the correlation function is not dependent on the absolute position of the sensors), and if it is also assumed that the field is spherically isotropic (i.e., uncorrelated signals from all directions), the displacement vector r can be replaced with a scalar variable r which is the spacing between the two measurement locations. In that case, the cross-spectral density for an isotropic field is the average cross-spectral density for all spherical directions θ, ϕ. Therefore, space-frequency cross-spectrum function G between the two sensors can be expressed by Equation (28) as follows:

$$G_{12}(r,\omega)=\frac{N_o(\omega)}{4\pi}\int_0^{\pi}\int_0^{2\pi}e^{-jkr\cos\theta}\sin\theta\,d\theta\,d\phi=\frac{N_o(\omega)\sin(\omega r/c)}{\omega r/c}=\frac{N_o(\omega)\sin(kr)}{kr} \tag{28}$$

where $N_o(\omega)$ is the power spectral density at the measurement locations and it has been assumed, without loss in generality, that the vector r lies along the z-axis. Note that the isotropic assumption implies that the auto power-spectral density is the same at each location. The complex spatial coherence function γ is defined as the normalized cross-spectral density according to Equation (29) as follows:

$$\gamma_{12}(r,\omega)=\frac{G_{12}(r,\omega)}{[G_{11}(\omega)G_{22}(\omega)]^{1/2}} \tag{29}$$

For spherically isotropic noise and omnidirectional microphones, the spatial coherence function is given by Equation (30) as follows:

$$\gamma(r,\omega)=\frac{\sin(kr)}{kr} \tag{30}$$

In general, the spatial coherence function can be determined by Equation (31) as follows:

$$\gamma_{12}(r,\omega)=\frac{E[T_1(\theta,\phi,\omega)T_2^*(\theta,\phi,\omega)e^{-jk\cdot r}]}{E[|T_1(\theta,\phi,\omega)|^2]^{1/2}E[|T_2(\theta,\phi,\omega)|^2]^{1/2}} \tag{31}$$

where E is the expectation operator over all incident angles, $T_1$ and $T_2$ are the directivity functions for the two directional sensors, and the superscript "*" denotes the complex conjugate. The vector r is the displacement vector between the two microphone locations and $r=\|r\|$. The angles θ and ϕ are the spherical coordinate angles (θ is the angle off the z-axis and ϕ is the angle in the x-y plane) and it is assumed, without loss in generality, that the sensors are aligned along the z-axis. In integral form, for spherically isotropic fields, Equation (31) can be written as Equation (32) as follows:

$$\gamma_{12}(r,\omega)=\frac{\int_0^{\pi}\int_0^{2\pi}T_1(\theta,\phi,\omega)T_2^*(\theta,\phi,\omega)e^{-jkr\cos\theta}\sin\theta d\theta d\phi}{\left[\int_0^{\pi}\int_0^{2\pi}|T_1(\theta,\phi,\omega)|^2\sin\theta d\theta d\phi\right]^{1/2}\left[\int_0^{\pi}\int_0^{2\pi}|T_2(\theta,\phi,\omega)|^2\sin\theta d\theta d\phi\right]^{1/2}} \tag{32}$$

For the specific case of the pressure sum (omni) and difference (dipole) signals, Equation (32) reduces to Equation (33) as follows:

$$\gamma_{dipole\text{-}omni}(r,\omega)=0\ \forall\omega,\ \forall r \tag{33}$$

Equation (33) restates a well-known result in room acoustics: that the acoustic particle velocity components and the pressure are uncorrelated in diffuse sound fields. However, if a phase error exists between the individual pressure microphones, then the ideal difference signal dipole pattern will become distorted, the numerator term in Equation (32) will not integrate to zero, and the estimated coherence will therefore not be zero.

As shown in Equation (27), the cross-spectrum for the pressure signals for a diffuse field is purely real. If there is phase mismatch between the microphones, then the imaginary part of the cross-spectrum will be nonzero, where the phase of the cross-spectrum is equal to the phase mismatch between the microphones. Thus, one can use the estimated cross-spectrum in a diffuse (cylindrical or spherical) sound field as an estimate of the phase mismatch between the individual channels and then correct for this mismatch. In order to use this concept, the acoustic noise field should be close to a true diffuse sound field. Although this may never be strictly true, it is possible to use typical noise fields that have equivalent acoustic energy propagation from the front and back of the microphone pair, which also results in a real cross-spectral density. One way of ascertaining the existence of this type of noise field is to use the estimated front and rear acoustic power from forward and rearward facing supercardioid beampatterns formed by appropriately combining two closely spaced pressure microphone signals. See, e.g., G. W. Elko, "Superdirectional Microphone Arrays," Acoustic Signal Processing for Telecommunication, S. L. Gay and J. Benesty, eds., Kluwer Academic Publishers, Chapter 10, pp. 181–237, Mar. 2000, the teachings of which are incorporated herein by reference. Alternatively, one could use an adaptive differential microphone system to form directional microphones whose output is representative of sound propagating from the front and rear of the microphone pair. See, e.g., G. W. Elko and A-T. Nguyen Pong. "A steerable and variable first-order differential microphone," In Proc. 1997 IEEE ICASSP, Apr. 1997, the teachings of which are incorporated herein by reference.

Finally, the results given in Equation (5) can be used to explicitly examine the effect of phase error on the difference signal between a pair of closely spaced pressure microphones. A change of variables gives the desired result according to Equation (34) as follows:

$$T_1(\omega,\theta)=P_o(1-e^{-j\omega(\phi(\omega)/\omega+d\cos\theta/c)}), \tag{34}$$

where $\phi(\omega)$ is equal to the phase error between the microphones. The quantity $\phi(\omega)/\omega$ is usually referred to as the phase delay. If a small spacing is again assumed ($kd<<\pi$ and $\phi(\omega)<<\pi$), then Equation (34) can be written as Equation (35) as follows:

$$|T_1(\omega,\theta)|\approx P_o\omega(\phi(\omega)/\omega+d/c\cos\theta) \tag{35}$$

If Equation (35) is squared and integrated over all angles of incidence in a diffuse field, then the differential output is minimized when the phase shift (error) between the microphones is zero. Thus, one can obtain a method to calibrate a microphone pair by introducing an appropriate phase function to one microphone channel that cancels the phase error between the microphones. The algorithm can be an adaptive algorithm, such as an LMS (Least Mean Square), NLMS (Normalized LMS), or Least-Squares, that minimizes the output power by adjusting the phase correction before the differential combination of the microphone signals in a diffuse sound field. The advantage of this approach is that only output powers are used and these quantities are the same as those for amplitude correction as well as for the turbulent noise detection and suppression described in previous sections.

Applications

Figure 9:
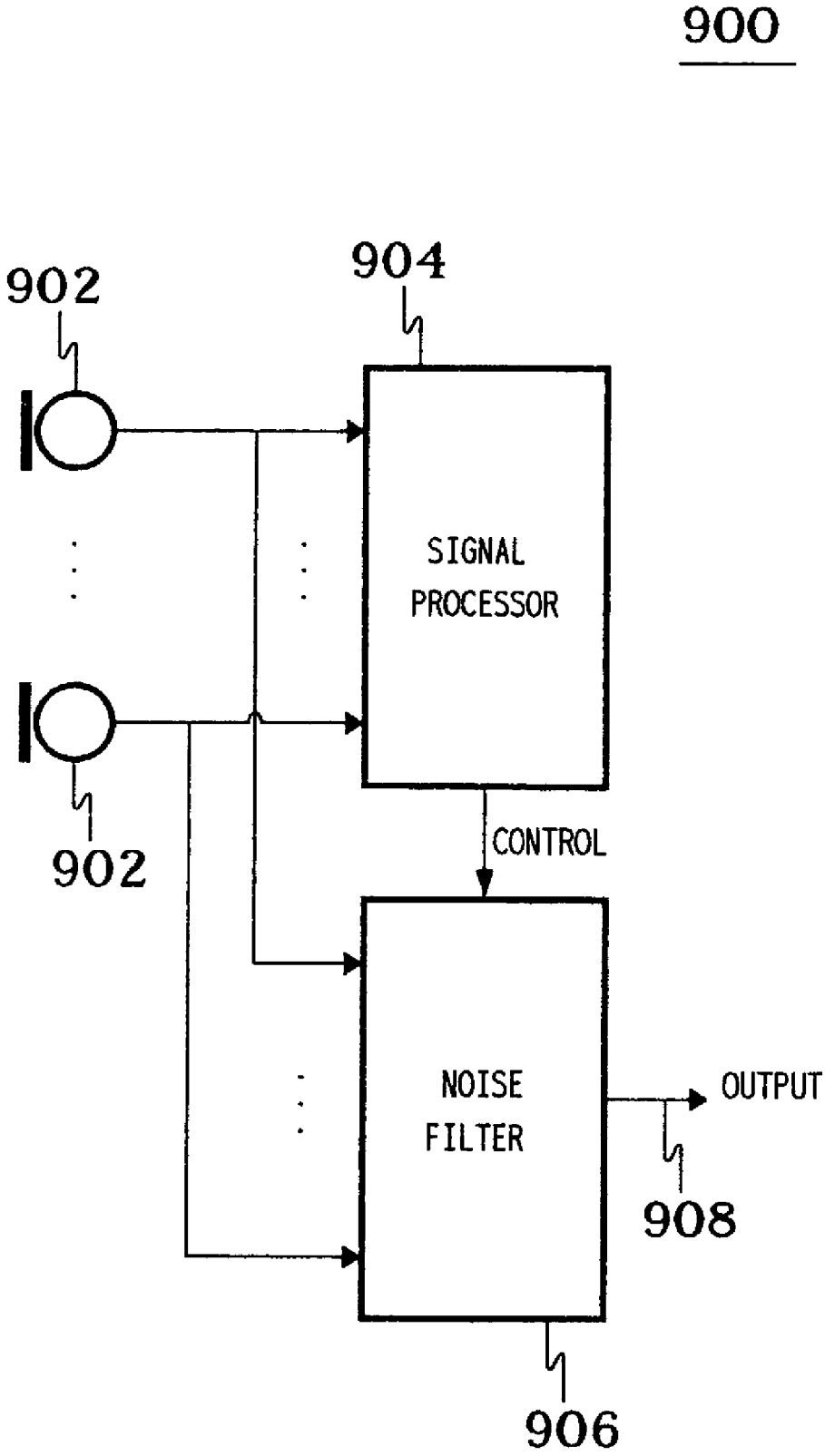
FIG. 9 shows a block diagram of an audio system, according to one embodiment of the present invention.

FIG. 9 shows a block diagram of an audio system 900, according to one embodiment of the present invention. Audio system 900 comprises two or more microphones 902, a signal processor 904, and a noise filter 906. Audio system 900 processes the audio signals generated by microphones 902 to attenuate noise resulting, e.g., from turbulent wind blowing across the microphones. In particular, signal processor 904 characterizes the linear relationship between the audio signals received from microphones 902 and generates control signals for adjusting the time-varying noise (e.g., Weiner) filter 906, which filters the audio signals from one or both microphones 902 to reduce the incoherence between those audio signals. Depending on the particular application, the noise-suppression filtering could be applied to the audio signal from only a single microphone 902. Alternatively, filtering could be applied to each audio signal. In certain beamforming applications in which the two or more audio signals are linearly combined to form an acoustic beam, the noise-suppression filtering could be applied once to the beamformed signal to reduce computational overhead. As used in this specification, the coherence between two audio signals refers to the degree to which the two signals are linearly related, while, analogously, the incoherence refers to the degree of non-linearity between those two signals. Depending on the particular application, noise filter 906 may generate one or more output signals 908. The resulting output signal(s) 908 are then available for further processing, which, depending on the application, may involve such steps as additional filtering, beamforming, compression, storage, transmission, and/or rendering.

Figure 10:
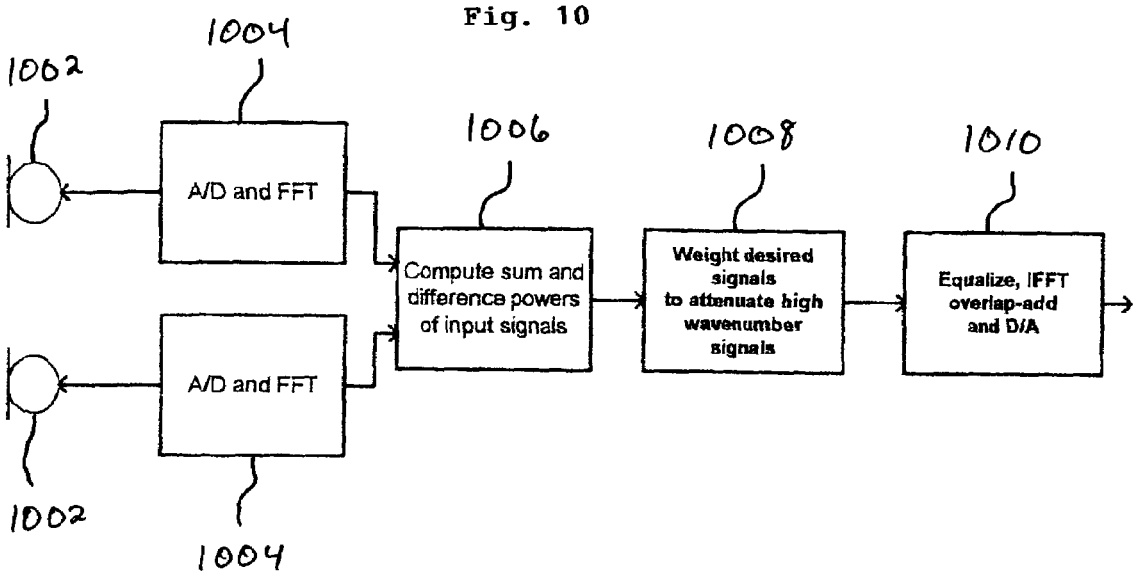
FIG. 10 shows a block diagram of turbulent wind-noise attenuation processing using two closely spaced, pressure (omnidirectional) microphones, according to one implementation of the audio system of FIG. 9.

FIG. 10 shows a block diagram of turbulent wind-noise attenuation processing, according to an implementation of audio system 900 having two closely spaced, pressure (omnidirectional) microphones 1002. In the embodiment of FIG. 10, signal processor 904 of FIG. 9 digitizes (A/D) and transforms (FFT) the audio signal from each omnidirectional microphone (blocks 1004) and then computes sum and difference powers of the resulting signals (block 1006) to generate control signals for adjusting noise filter 906 over time. Noise filter 906 weights desired signals to attenuate high wavenumber signals (block 1008) and filters (e.g., equalize, IFFT, overlap-add, and D/A) the weighted signals to generate output signal(s) 908 (block 1010). Although any suitable frequency-domain decomposition could be utilized (such as filter-bank, non-uniform filter-bank, or wavelet decomposition), uniform short-time Fourier FFT-based analysis, modification, and synthesis via overlap-add are shown. The overlap-add method is a standard signal processing technique where short-time Fourier domain signals are transformed into the time domain and the final output time signal is reconstructed by overlapping and adding previous block output signals from overlapped sampled input blocks.

Figure 11:
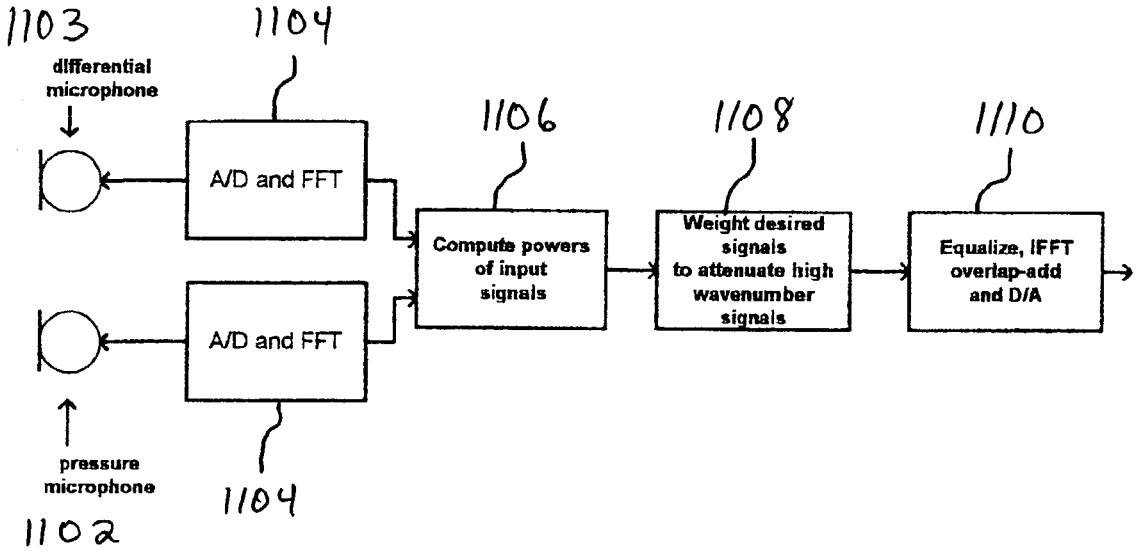
FIG. 11 shows a block diagram of turbulent wind-noise attenuation processing using a directional microphone and a pressure (omnidirectional) microphone, according to an alternative implementation of the audio system of FIG. 9.

FIG. 11 shows a block diagram of turbulent wind-noise attenuation processing, according to an alternative implementation of audio system 900 having a pressure (omnidirectional) microphone 1102 and a differential microphone 1103. In this implementation, attenuation of turbulent energy is accomplished by comparing the output of a fixed, equalized differential microphone 1102 to that of omnidirectional microphone 1103 (or even another directional microphone). The processing of FIG. 11 is similar to that of FIG. 10, except that block 1006 of FIG. 10 is replaced by block 1106 of FIG. 11. Although this implementation may seem different from the previous use of sum and difference powers, it is essentially equivalent.

Since the differential microphone effectively uses the pressure difference or the acoustic particle velocity, the output power is directly related to the difference signal power from two closely space pressure microphones. The output power from a single pressure microphone is essentially the same (aside from a scale factor) as that of the summation of two closely space pressure microphones. As a result, an implementation using comparisons of the output powers of a directional differential microphone and an omnidirectional pressure microphone is equivalent to the systems described in the section entitled "Wind Noise Suppression."

Figure 12:
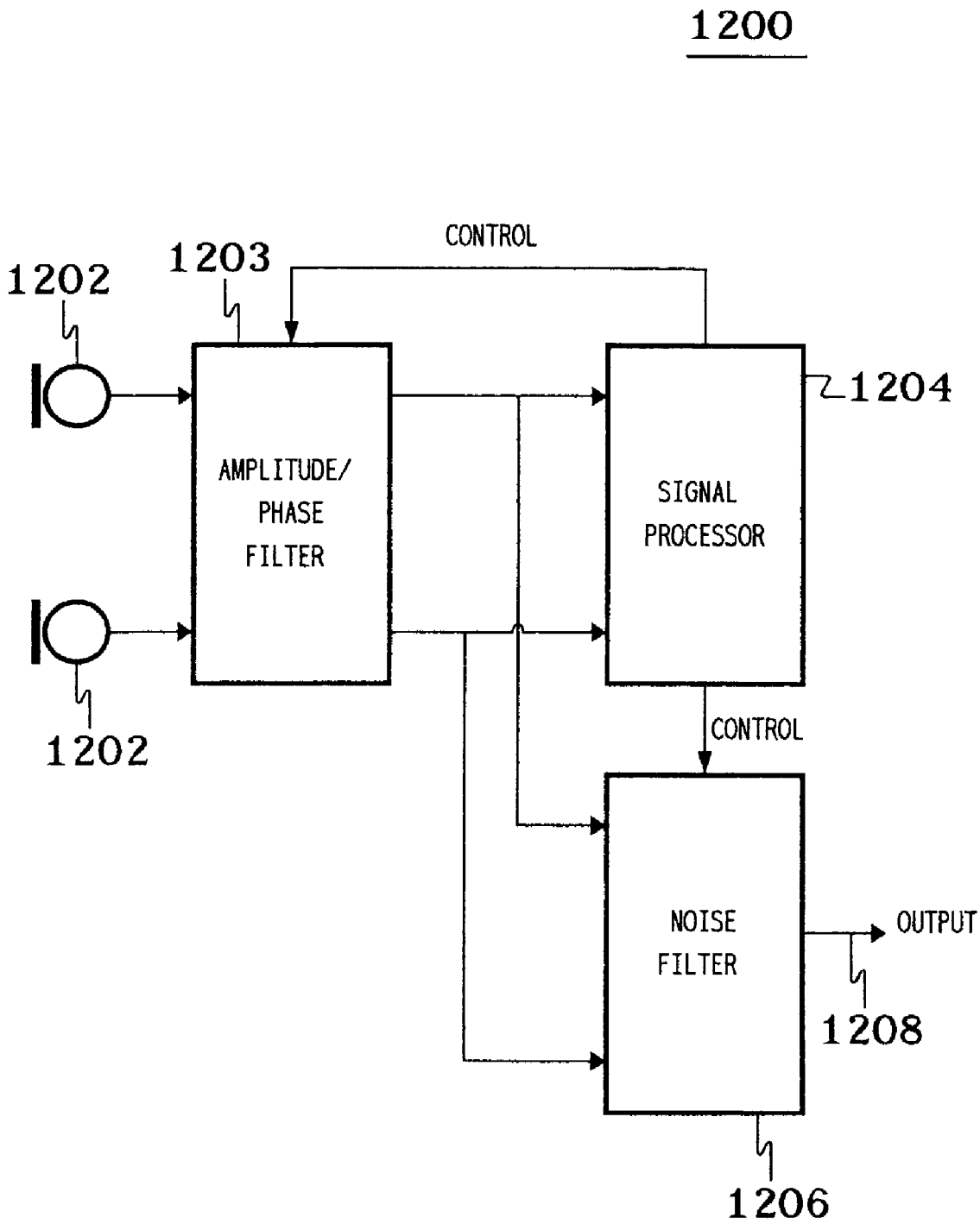
FIG. 12 shows a block diagram of an audio system having two omnidirectional microphones, according to an alternative embodiment of the present invention.

FIG. 12 shows a block diagram of an audio system 1200 having two omnidirectional microphones 1202, according to an alternative embodiment of the present invention. Like audio system 900 of FIG. 9, audio system 1200 comprises a signal processor 1204 and a time-varying noise filter 1206, which operate to attenuate, e.g., turbulent wind-noise in the audio signals generated by the two microphones in a manner analogous to the corresponding components in audio system 900.

In addition to attenuating turbulent wind-noise, audio system 1200 also calibrates and corrects for differences in amplitude and phase between the two microphones 1202. To achieve this additional functionality, audio system 1200 comprises amplitude/phase filter 1203, and, in addition to estimating coherence between the audio signals received from the microphones, signal processor 1204 also estimates the amplitude and phase differences between the microphones. In particular, amplitude/phase filter 1203 filters the audio signals generated by microphones 1202 to correct for amplitude and phase differences between the microphones, where the corrected audio signals are then provided to both signal processor 1204 and noise filter 1206. Signal processor 1204 monitors the calibration of the amplitude and phase differences between microphones 1202 and, when appropriate, feeds control signals back to amplitude/phase filter 1203 to update its calibration processing for subsequent audio signals. The calibration filter can also be estimated by using adaptive filters such as LMS (Least Mean Square), NLMS (Normalized LMS), or Least Squares to estimate the mismatch between the microphones. The adaptive system identification would only be active when the field was determined to be diffuse. The adaptive step-size could be controlled by the estimation as to how diffuse and spectrally broad the sound field is, since we want to adapt only when the sound field fulfills these conditions. The adaptive algorithm can be run in the background using the common technique of "two-path" estimation common to acoustic echo cancellation. See, e.g., K. Ochiai, T. Araseki, and T. Ogihara, "Echo canceller with two echo path models," IEEE Trans. Commun., vol. COM-25, pp. 589–595, Jun. 1977, the teachings of which are incorporated herein by reference. By running the adaptive algorithm in the background, it becomes easy to detect a better estimation of the amplitude and phase mismatch between the microphones, since we only need compare error powers between the current calibrated microphone signals and the background "shadowing" adaptive microphone signals.

Figure 13:
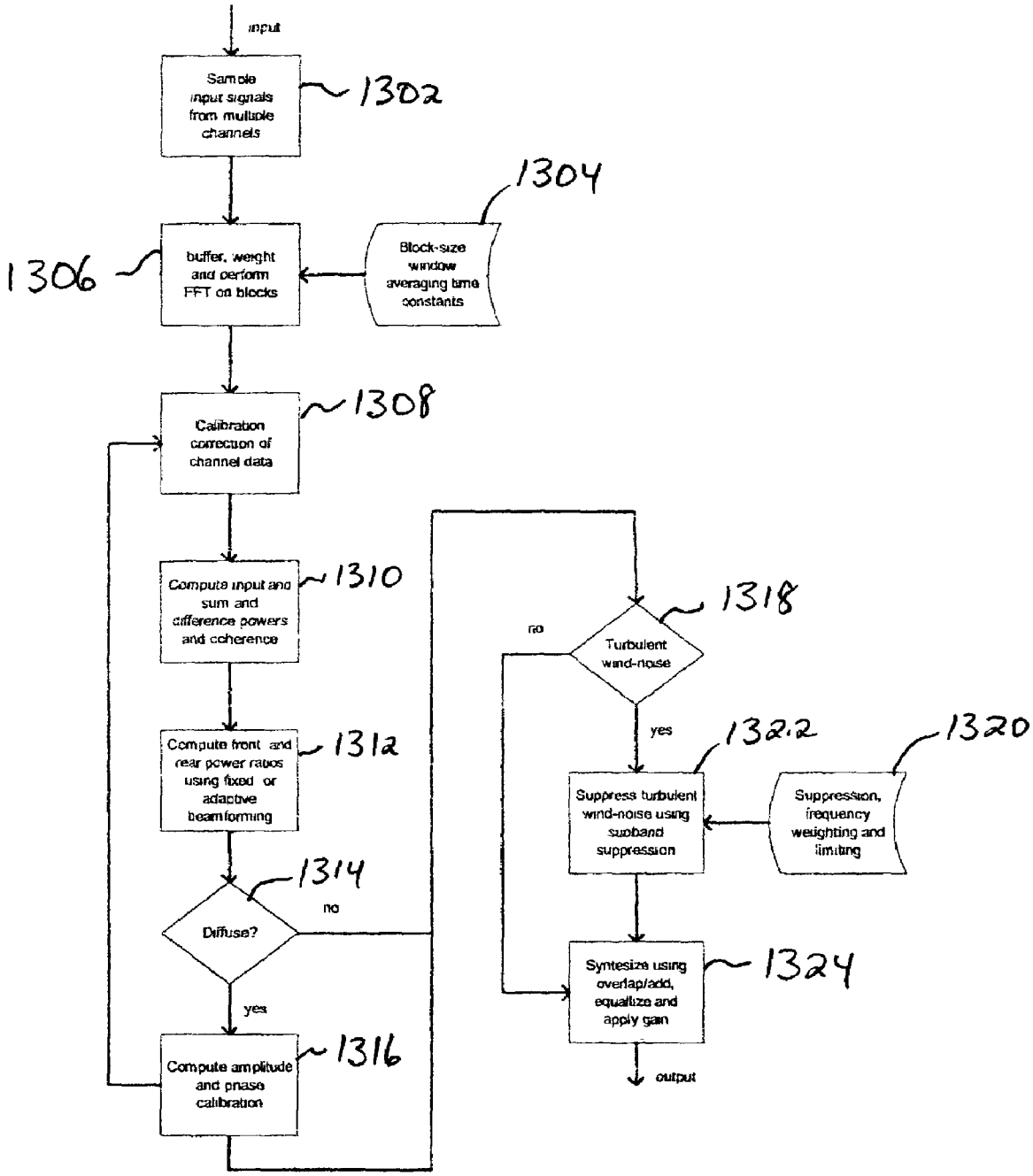
FIG. 13 shows a flowchart of the processing of the audio system of FIG. 12, according to one embodiment of the present invention.

FIG. 13 shows a flowchart of the processing of audio system 1200 of FIG. 12, according to one embodiment of the present invention. In particular, the input signals from the two omnidirectional microphones 1202 are sampled (i.e., A/D converted) (step 1302 of FIG. 13). Based on the specification of block-size window averaging time constants (step 1304), blocks of the sampled digital audio signals are buffered, optionally weighted, and fast Fourier transformed (FFT) (step 1306). The resulting frequency data for one or both of the audio signals are then corrected for amplitude and phase differences between the microphones (step 1308).

After this amplitude/phase correction, the input and sum and difference powers are generated for the two channels as well as the coherence (i.e., linear relationship) between the channels, for example, based on Equation (8) (step 1310). Depending on the implementation, coherence between the channels can be characterized once for the entire frequency range or independently within different frequency sub-bands in a filter-bank implementation. In this latter implementation, the sum and difference powers would be computed in each sub-band and then appropriate gains would be applied across the sub-bands to reduce the estimated turbulence-induced noise. Depending on the implementation, a single gain could be chosen for each sub-band, or a vector gain could be applied via a filter on the sub-band signal. In general, it is preferable to choose the gain suppression that would be appropriate for the highest frequency covered by the sub-band. That way, the gain (attenuation) factor will be minimized for the band. This might result in less-than-maximum suppression, but would typically provide less suppression distortion.

In this particular implementation, phase calibration is limited to those periods in which the incoming sound field is sufficiently diffuse. The diffuseness of the incoming sound field is characterized by computing the front and rear power ratios using fixed or adaptive beamforming (step 1312), e.g., by treating the two omnidirectional microphones as the two sensors of a differential microphone in a cardioid configuration. If the difference between the front and rear power ratios is sufficiently small (step 1314), then the sound field is determined to be sufficiently diffuse to support characterization of the phase difference between the two microphones.

Alternatively, the coherence function, e.g., estimated using Equation (8), can be used to ascertain if the sound field is sufficiently diffuse. In one implementation, this determination could be made based on the ratio of the integrated coherence functions for two different frequency regions. For example, the coherence function of Equation (8) could be integrated from frequency f1 to frequency f2 in a relatively low-frequency region and from frequency f3 to frequency f4 in a relatively high-frequency region to generate low- and high-frequency integrated coherence measures, respectively. Note that the two frequency regions can have equal or non-equal bandwidths, but, if the bandwidths are not equal, then the integrated coherence measures should be scaled accordingly. If the ratio of the high-frequency integrated coherence measure to the low-frequency integrated coherence measure is less than some specified threshold value, then the sound field may be said to be sufficiently diffuse.

In any case, if the sound field is determined to be sufficiently diffuse, then the relative amplitude and phase of the microphones is computed (step 1316) and used to update the calibration correction processing of step 1306 for subsequent data. In preferred implementations, the calibration update performed during step 1316 is sufficiently conservative such that only a fraction of the calculated differences is updated at any given cycle. In particular implementations, if the phase difference between the microphones is sufficiently large (i.e., too large to accurately correct), then the calibration correction processing of step 1306 could be updated to revert to a single-microphone mode, where the audio signal from one of the microphones (e.g., the microphone with the least power) is ignored. In addition or alternatively, a message (e.g., a pre-recorded message) could be generated and presented to the user to inform the user of the existence of the problem.

Whether or not the amplitude and phase calibration is updated in step 1316, processing continues to step 1318 where the difference-to-sum power ratio (e.g., in each sub-band) is thresholded to determine whether turbulent wind-noise is present. In general, if the magnitude of the difference between the sum and difference powers is less than a specified threshold level, then turbulent wind-noise is determined to be present. In that case, based on the specification of input parameters (e.g., suppression, frequency weighting and limiting) (step 1320), sub-band suppression is used to reduce (attenuate) the turbulent wind-noise in each sub-band, e.g., based on Equation (27) (step 1322). In alternative implementations, step 1318 may be omitted with step 1322 always implemented to attenuate whatever degree of incoherence exists in the audio signals. The preferred implementation may depend on the sensitivity of the application to suppression distortion that results from the filtering of step 1322. Whether or not turbulent wind-noise attenuation is performed, processing continues to step 1324 where output signal(s) 1208 of FIG. 12 are generated using overlap/adding, equalization, and the application of gain.

In one possible implementation, amplitude/phase filter 1203 of FIG. 12 performs steps 1302–1306 of FIG. 13, signal processor 1204 performs steps 1308–1318, and noise filter 1206 performs steps 1320–1324.

Another simple algorithmic procedure to mitigate turbulence would be to use the detection scheme as described above and switch the output signal to the pressure or pressure-sum signal output. This implementation has the advantage that it could be accomplished without any signal processing other than the detection of the output power ratio between the sum and difference or pressure and differential microphone signals. The price one pays for this simplicity is that the microphone system abandons its directionality during situations where turbulence is dominant. This approach could produce a sound output whose sound quality would modulate as a function of time (assuming turbulence is varying in time) since the directional gain would change dynamically. However, the simplicity of such a system might make it attractive in situations where significant digital signal processing computation is not practical.

In one possible implementation, the calibration processing of steps 1312–1316 is performed in the background (i.e., off-line), where the correction processing of step 1306 continues to use a fixed set of calibration parameters. When the processor determines that the revised calibration parameters currently generated by the background calibration processing of step 1316 would make a significant enough improvement in the correction processing of step 1306, the on-line calibration parameters of step 1306 are updated.

Conclusions

In preferred embodiments, the present invention is directed to a technique to detect turbulence in microphone systems having two or more sensors. The idea utilizes the measured powers of sum and difference signals between closely spaced pressure or directional microphones. Since the ratio of the difference and sum signal powers is quite similar when turbulent air flow is present and small when desired acoustic signals are present, one can detect turbulence or high-wavenumber low-speed (relative to propagating sound) fluid perturbations.

A Wiener filter implementation for turbulence reduction was derived and other ad hoc schemes described. Another algorithm presented was related to the Wiener filter approach and was based on the measured short-time coherence function between microphone pairs. Since the length scale of turbulence is smaller than typical spacing used in differential microphones, weighting the output signal by the estimated coherence function (or some processed version of the coherence function) will result in a filtered output signal that has a greatly reduced turbulent signal component. Experimental results were shown where the reduction of wind noise turbulence was reduced by more than 20 dB. Some simplified variations using directional and non-directional microphone outputs were described, as well as a simple microphone-switching scheme.

Finally, careful calibration is preferably performed for optimal operation of the turbulence detection schemes presented. Amplitude calibration can be accomplished by examining the long-time power outputs from the microphones. A few techniques based on the assumption of a diffuse sound field or equal front and rear acoustic energy or the ratio of integrated frequency bands of the estimated coherence between microphones were proposed for automatic phase calibration of the microphones.

Although the present invention is described in the context of systems having two microphones, the present invention can also be implemented using more than two microphones. Note that, in general, the microphones may be arranged in any suitable one-, two-, or even three-dimensional configuration. For instance, the processing could be done with multiple pairs of microphones that are closely spaced and the overall weighting could be a weighted and summed version of the pair-weights as computed in Equation (27). In addition, the multiple coherence function (reference: Bendat and Piersol, "Engineering applications of correlation and spectral analysis", Wiley Interscience, 1993.) could be used to determine the amount of suppression for more than two inputs. The use of the difference-to-sum power ratio can also be extended to higher-order differences. Such a scheme would involve computing higher-order differences between multiple microphone signals and comparing them to lower-order differences and zero-order differences (sums). In general, the maximum order is one less than the total number of microphones, where the microphones are preferably relatively closely spaced.

In a system having more than two microphones, audio signals from a subset of the microphones (e.g., the two microphones having greatest power) could be selected for filtering to compensate for phase difference. This would allow the system to continue to operate even in the event of a complete failure of one (or possibly more) of the microphones.

The present invention can be implemented for a wide variety of applications in which noise in audio signals results from air moving relative to a microphone, including, but certainly not limited to, hearing aids, cell phones, and consumer recording devices such as camcorders. Notwithstanding their relatively small size, individual hearing aids can now be manufactured with two or more sensors and sufficient digital processing power to significantly reduce turbulent wind-noise using the present invention. The present invention can also be implemented for outdoor-recording applications, where wind-noise has traditionally been a problem. The present invention will also reduce noise resulting from the jet produced by a person speaking or singing into a close-talking microphone.

Although the present invention has been described in the context of attenuating turbulent wind-noise, the present invention can also be applied in other application, such as underwater applications, where turbulence in the water around hydrophones can result in noise in the audio signals. The invention can also be useful for removing bending wave vibrations in structures below the coincidence frequency where the propagating wave speed becomes less than the speed of sound in the surrounding air or fluid.

Although the calibration processing of the present invention has been described in the context of audio systems that attenuate turbulent wind-noise, those skilled in the art will understand that this calibration estimation and correction can be applied to other audio systems in which it is required or even just desirable to use two or more microphones that are matched in amplitude and/or phase.

The present invention may be implemented as circuit-based processes, including possible implementation on a single integrated circuit. As would be apparent to one skilled in the art, various functions of circuit elements may also be implemented as processing steps in a software program. Such software may be employed in, for example, a digital signal processor, micro-controller, or general-purpose computer.

The present invention can be embodied in the form of methods and apparatuses for practicing those methods. The present invention can also be embodied in the form of program code embodied in tangible media, such as floppy diskettes, CD-ROMs, hard drives, or any other machine-readable storage medium, wherein, when the program code is loaded into and executed by a machine, such as a computer, the machine becomes an apparatus for practicing the invention. The present invention can also be embodied in the form of program code, for example, whether stored in a storage medium, loaded into and/or executed by a machine, or transmitted over some transmission medium or carrier, such as over electrical wiring or cabling, through fiber optics, or via electromagnetic radiation, wherein, when the program code is loaded into and executed by a machine, such as a computer, the machine becomes an apparatus for practicing the invention. When implemented on a general-purpose processor, the program code segments combine with the processor to provide a unique device that operates analogously to specific logic circuits.

Unless explicitly stated otherwise, each numerical value and range should be interpreted as being approximate as if the word "about" or "approximately" preceded the value of the value or range.

It will be further understood that various changes in the details, materials, and arrangements of the parts which have been described and illustrated in order to explain the nature of this invention may be made by those skilled in the art without departing from the principle and scope of the invention as expressed in the following claims. Although the steps in the following method claims, if any, are recited in a particular sequence with corresponding labeling, unless the claim recitations otherwise imply a particular sequence for implementing some or all of those steps, those steps are not necessarily intended to be limited to being implemented in that particular sequence.

What is claimed is:

1. A method for processing audio signals generated by two or more microphones receiving acoustic signals, comprising the steps of:

(a) generating a ratio of sum and difference signal powers for the audio signals; and (b) filtering at least one of the audio signals based on the ratio to reduce a portion of the audio signals resulting from one or more of (i) incoherence between the audio signals and (ii) one or more audio-signal sources having propagation speeds different from the acoustic signals.

2. The invention of claim 1, wherein the audio signals are generated by two microphones, wherein:

a first microphone is either an omnidirectional microphone or a differential microphone;

a second microphone is either an omnidirectional microphone or a differential microphone the one or more audio-signal sources comprises turbulent wind blowing across at least one of the two or more microphones;

at least some of the incoherence between the audio signals results from microphone self-noise; and the method is implemented by a hearing aid, a cell phone, or a consumer recording device.

3. The invention of claim 1, wherein step (a) comprises updating one or more filter parameters used during the filtering of step (b) based on the sum and difference signal powers.

4. The invention of claim 3, wherein the sum and difference powers are generated using audio signals from more than two microphones.

5. The invention of claim 1, wherein the filtering of step (b) is further based on an idealized ratio of sum and difference signal powers for an idealized response of the two or more microphones receiving acoustic signals from a specified direction.

6. The invention of claim 5, wherein the two or more microphones are positioned along a linear axis, and the specified direction corresponds to acoustic signals arriving along the axis.

7. The invention of claim 1, wherein steps (a) and (b) are implemented independently for each of two or more different frequency sub-bands in the audio signals.

8. An audio system for processing audio signals generated by two or more microphones receiving acoustic signals, the audio system comprising:

(a) a signal processor configured to generate a ratio of sum and difference signal powers for the audio signals; and (b) a filter configured to filter at least one of the audio signals based on the ratio to reduce a portion of the audio signals resulting from one or more of (i) incoherence between the audio signals and (ii) one or more audio-signal sources having propagation speeds different from the acoustic signals.

9. The invention of claim 8, wherein the audio signals are generated by two microphones, wherein:

the audio system comprises the two microphones;

a first microphone is either an omnidirectional microphone or a differential microphone;

a second microphone is either an omnidirectional microphone or a differential microphone;

the one or more audio-signal sources comprises turbulent wind blowing across at least one of the microphones;

at least some of the incoherence between the audio signals results from microphone self-noise; and the audio system is part of a hearing aid, a cell phone, or a consumer recording device.

10. The invention of claim 8, wherein the signal processor is configured to update one or more filter parameters used by the filter based on the sum and difference signal powers.

11. The invention of claim 10, wherein the signal processor generates the sum and difference powers using audio signals from more than two microphones.

12. The invention of claim 8, wherein the filtering performed by the filter is further based on an idealized ratio of sum and difference signal powers for an idealized response of the two or more microphones receiving acoustic signals from a specified direction.

13. The invention of claim 12, wherein the two or more microphones are positioned along a linear axis, and the specified direction corresponds to acoustic signals arriving along the axis.

14. The invention of claim 8, wherein processing of the signal processor and the filter is implemented independently for each of two or more different frequency sub-bands in the audio signals.

15. A consumer device comprising:

(a) two or more microphones configured to receive acoustic signals and to generate audio signals;

(b) a signal processor configured to generate a ratio of sum and difference signal powers for the audio signals; and (c) a filter configured to filter at least one of the audio signals based on the ratio to reduce a portion of the audio signals resulting from one or more of (i) incoherence between the audio signals and (ii) one or more audio-signal sources having propagation speeds different from the acoustic signals.

16. The invention of claim 15, wherein the consumer device is one of a hearing aid, a cell phone, and a consumer recording device.

17. The method of claim 1, wherein the audio signals are generated in response to a sound field by the at least two microphones of an audio system, and further comprising the steps of:

(c) filtering the audio signals to compensate for a phase difference between the at least two microphones;

(d) generating a revised phase difference between the at least two microphones based on the audio signals; and (e) updating, based on the revised phase difference, at least one calibration parameter used during the filtering of step (c).

18. The invention of claim 17, wherein step (d) comprises the step of characterizing diffuseness of the sound field based on the audio signals, wherein the revised phase difference is generated only when the characterized diffuseness of the sound field is determined to be greater than a specified diffuseness threshold level.

19. The invention of claim 18, wherein step (d) comprises the steps of:

(1) generating front and rear power ratios based on the audio signals; and (2) comparing the front and rear power ratios to characterize the diffuseness of the sound field.

20. The invention of claim 19, wherein the front and rear power ratios are generated by treating the at least two microphones as sensors in a differential microphone having a cardioid configuration.

21. The invention of claim 18, wherein step (d) comprises the steps of:

(1) generating an integrated coherence function for each of two different frequency regions; and (2) comparing the integrated coherence functions for the two different frequency regions to characterize the diffuseness of the sound field.

22. The invention of claim 17, wherein:

the method is implemented by a hearing aid, a cell phone, or a consumer recording device;

step (c) further comprises the step of filtering the audio signals to compensate for an amplitude difference between the at least two microphones;

step (d) further comprises the step of generating a revised amplitude difference between the at least two microphones based on the audio signals; and step (e) further comprises the step of updating, based on the revised amplitude difference, at least one calibration parameter used in the filtering of step (c).

23. The invention of claim 17, wherein step (e) comprises the step of switching to a single-microphone mode when the revised phase difference is sufficiently large.

24. The invention of claim 23, wherein step (e) comprises the step of selecting a microphone having greatest power for the single-microphone mode.

25. The invention of claim 17, wherein step (e) comprises the step of generating a message to notify a user of the existence of a problem when the revised phase difference or an amplitude difference between the at least two microphones is sufficiently large.

26. The invention of claim 17, wherein:

the revised phase difference is computed using background processing;

step (d) further comprises the step of determining how much using the revised phase difference would improve the filtering of step (c); and the at least one calibration parameter is updated based on the revised phase difference when doing so improves the filtering of step (c) by a sufficient amount.

27. The invention of claim 17, wherein:

the audio system comprises more than two microphones; and step (c) comprises the step of filtering the audio signals from a subset of the microphones to compensate for the phase difference.

28. The invention of claim 27, wherein the subset corresponds to microphones having greatest power.

29. The audio system of claim 8, further comprising:

a second filter configured to filter the audio signals generated in response to a sound field by the at least two microphones to compensate for a phase difference between the at least two microphones; and the signal processor is further configured to:

(1) generate a revised phase difference between the at least two microphones based on the audio signals; and (2) update, based on the revised phase difference, at least one calibration parameter used by the second filter.

30. The invention of claim 29, wherein the audio system further comprises the at least two microphones.

31. The invention of claim 29, wherein the signal processor is configured to characterize diffuseness of the sound field based on the audio signals, wherein the revised phase difference is generated only when the characterized diffuseness of the sound field is determined to be greater than a specified diffuseness threshold level.

32. The invention of claim 31, wherein the signal processor is configured to:

(A) generate front and rear power ratios based on the audio signals; and (B) compare the front and rear power ratios to characterize the diffuseness of the sound field.

33. The invention of claim 32, wherein the front and rear power ratios are generated by treating the at least two microphones as sensors in a differential microphone having a cardioid configuration.

34. The invention of claim 31, wherein the signal processor is configured to:

(A) generate an integrated coherence function for each of two different frequency regions; and (B) compare the integrated coherence functions for the two different frequency regions to characterize the diffuseness of the sound field.

35. The invention of claim 29, wherein:

the apparatus is part of a hearing aid, a cell phone, or a consumer recording device;

the second filter is further configured to filter the audio signals to compensate for an amplitude difference between the at least two microphones; and the signal processor is further configured to:

(i) generate a revised amplitude difference between the at least two microphones based on the audio signals; and (ii) update, based on the revised amplitude difference, at least one calibration parameter used by the second filter.

36. The invention of claim 29, wherein the signal processor is configured to switch to a single-microphone mode when the revised phase difference or an amplitude difference between the at least two microphones is sufficiently large.

37. The invention of claim 36, wherein the signal processor is configured to select a microphone having greatest power for the single-microphone mode.

38. The invention of claim 29, wherein the signal processor is configured to generate a message to notify a user of the existence of a problem when the revised phase difference is sufficiently large.

39. The invention of claim 29, wherein:

the revised phase difference is computed using background processing;

the signal processor is further configured to determine how much using the revised phase difference would improve the second filter; and the at least one calibration parameter is updated based on the revised phase difference when doing so improves the second filter by a sufficient amount.

40. The invention of claim 29, wherein:

the audio system comprises more than two microphones; and the signal processor is configured to filter the audio signals from a subset of the microphones to compensate for the phase difference.

41. The invention of claim 40, wherein the subset corresponds to microphones having greatest power.

42. The consumer device of claim 15, further comprising:

a second filter configured to the filter audio signals generated in response to a sound field by the at least two microphones to compensate for a phase difference between the at least two microphones; and the signal processor is further configured to:

(1) generate a revised phase difference between the at least two microphones based on the audio signals; and (2) update, based on the revised phase difference, at least one calibration parameter used by the second filter.

43. The invention of claim 42, wherein the consumer device is a hearing aid, a cell phone, or a consumer recording device.

44. The invention of claim 1, wherein:

at least some of the portion results from incoherence between the audio signals; and at least some of the incoherence results from presence of a diffuse acoustic noise field.

45. The invention of claim 1, wherein the audio signals are generated by an omnidirectional microphone and a differential microphone.

46. The invention of claim 1, wherein the audio signals are generated by two omnidirectional microphones.

47. The invention of claim 8, wherein:

at least some of the portion results from incoherence between the audio signals; and at least some of the incoherence results from presence of a diffuse acoustic noise field.

48. The invention of claim 8, wherein the two or more microphones comprise an omnidirectional microphone and a differential microphone.

49. The invention of claim 8, wherein the two or more microphones comprise two omnidirectional microphones.

50. The invention of claim 1, wherein the method is implemented without generating any cross correlation or cross power spectrum of the audio signals.

51. The invention of claim 8, wherein the signal processor and the filter are adapted to process the audio signals without generating any cross correlation or cross power spectrum of the audio signals.

52. The invention of claim 15, wherein the signal processor and the filter are adapted to process the audio signals without generating any cross correlation or cross power spectrum of the audio signals.

53. The invention of claim 1, wherein the filtering is implemented independent of any cross correlation or cross power spectrum of the audio signals.

54. The invention of claim 8, wherein the filter is adapted to operate independent of any cross correlation or cross power spectrum of the audio signals.

55. The invention of claim 15, wherein the filter is adapted to operate independent of any cross correlation or cross power spectrum of the audio signals.

* * * * *

UNITED STATES PATENT AND TRADEMARK OFFICE

CERTIFICATE OF CORRECTION

PATENT NO. : 7,171,008 B2
APPLICATION NO. : 10/193825
DATED : January 30, 2007
INVENTOR(S) : Gary W. Elko It is certified that error appears in the above-identified patent and that said Letters Patent is hereby corrected as shown below:

On title page Item [56]

In U.S. PATENT DOCUMENTS, in the References Cited section, please add --5,610,991, 03/1997, Janse, 381/92--.

In U.S. PATENT DOCUMENTS, in the References Cited section, please add --US 2005/0276423 A1, 12/2005, Aubauer et al., 381/92--.

In U.S. PATENT DOCUMENTS, in the References Cited section, please add --3,626,365, 12/1971, Press, 340/34--.

In U.S. PATENT DOCUMENTS, in the References Cited section, please add --4,741,038, 04/1988, Elko et al., 381/92--.

In U.S. PATENT DOCUMENTS, in the References Cited section, please add --5,524,056 06/1996, Killion et al., 381/68.2--.

Signed and Sealed this

Thirteenth Day of May, 2008

JON W. DUDAS
*Director of the United States Patent and Trademark Office*